US007229243B2

(12) United States Patent
Nikpour et al.

(10) Patent No.: US 7,229,243 B2
(45) **Date of Patent: *Jun. 12, 2007**

(54) COMPRESSOR

(75) Inventors: Bahram Nikpour, Huddersfield (GB); Roy Saxton, Meltham Holmfirth (GB); Steven Howarth, Golcar (GB); Paul A. Eynon, Shelley (GB)

(73) Assignee: Holset Engineering Company, Limited, Huddersfield (GB)

( * ) Notice: Subject to any disclaimer, the term of this patent is extended or adjusted under 35 U.S.C. 154(b) by 130 days.

This patent is subject to a terminal disclaimer.

(21) Appl. No.: 10/818,640

(22) Filed: Apr. 6, 2004

(65) Prior Publication Data

US 2005/0008484 A1 Jan. 13, 2005

(30) Foreign Application Priority Data

Apr. 30, 2003 (GB) ..... 0309892.8

(51) Int. Cl.
*F03B 1/00* (2006.01)

(52) U.S. Cl. ..... 415/57.1; 415/58.2; 415/144; 415/914

(58) Field of Classification Search ..... 415/57.1, 415/57.3, 58.2, 58.3, 58.4, 58.5, 144, 914
See application file for complete search history.

(56) References Cited

U.S. PATENT DOCUMENTS

| | | | | |
|---|---|---|---|---|
| 4,743,161 | A | 5/1988 | Fisher et al. | |
| 4,834,611 | A * | 5/1989 | Meng | 415/58.5 |
| 4,990,053 | A * | 2/1991 | Rohne | 415/58.4 |
| 5,246,335 | A * | 9/1993 | Mitsubori et al. | 415/58.3 |
| 5,333,990 | A * | 8/1994 | Foerster et al. | 415/58.4 |
| 6,623,239 | B2 * | 9/2003 | Sahay et al. | 415/58.4 |
| 6,726,441 | B2 * | 4/2004 | Sumser et al. | 415/58.3 |
| 2005/0002782 | A1 * | 1/2005 | Nikpour et al. | 415/208.1 |
| 2005/0163606 | A1 * | 7/2005 | Svihla et al. | 415/58.4 |

FOREIGN PATENT DOCUMENTS

| | | |
|---|---|---|
| EP | 0547535 | 6/1993 |
| GB | 2319809 | 6/1998 |
| WO | WO 98/16747 | 4/1998 |

* cited by examiner

*Primary Examiner*—Igor Kershteyn
(74) *Attorney, Agent, or Firm*—J. Bruce Schelkopf, Esq.; Krieg DeVault, LLP

(57) ABSTRACT

A compressor for compressing a gas comprises an impeller wheel (1) mounted within a housing (2) defining an inlet and an outlet (6). The inlet comprises an outer tubular wall (7) extending away from the impeller wheel in an upstream direction and forming a gas intake portion (8) of the inlet, and an inner tubular wall (9) of diameter D extending away from the impeller wheel in an upstream direction within the outer tubular wall (7) and defining an inducer portion (10) of the inlet. An annular gas flow passage (11) is defined between the inner and outer tubular walls (9, 7) and has an upstream end and a downstream end separated by a length L1 measured along its axis. The upstream end of the annular passage (11) communicates with the intake or inducer portions of the inlet through at least one upstream aperture and at least one downstream aperture (13) communicates between a downstream portion of the annular flow passage (11) and the impeller. The inner tubular wall (9) has a length L2 extending upstream from the downstream aperture(s) (13). The length of the inner tubular wall (9) is such that L1/D>0.65 and/or L2/D>0.6.

15 Claims, 4 Drawing Sheets

FIGURE 2 - Surge margin improvement

COMPRESSOR

The present application claims priority to British Patent Application No. 0309892.8, filed Apr. 30, 2003, which is incorporated herein by reference.

The present invention relates to a compressor. In particular, the invention relates to the inlet arrangement of a centrifugal compressor such as, for example, the compressor of a turbocharger.

A compressor comprises an impeller wheel, carrying a plurality of blades (or vanes) mounted on a shaft for rotation within a compressor housing. Rotation of the impeller wheel causes gas (e.g. air) to be drawn into the impeller wheel and delivered to an outlet chamber or passage. In the case of a centrifugal compressor the outlet passage is in the form of a volute defined by the compressor housing around the impeller wheel and in the case of an axial compressor the gas is discharged axially.

In a conventional turbocharger the impeller wheel is mounted to one end of a turbocharger shaft and is rotated by an exhaust driven turbine wheel mounted within a turbine housing at the other end of the turbocharger shaft. The shaft is mounted for rotation on bearing assemblies housed within a bearing housing positioned between the compressor and turbine housings.

In some turbochargers the compressor inlet has a structure that has become known as a "a map width enhanced" (MWE) structure. An MWE structure is described for instance in U.S. Pat. No. 4,743,161. The inlet of such an MWE compressor comprises two coaxial tubular inlet sections, an outer inlet section or wall forming the compressor intake and inner inlet section wall defining the compressor inducer, or main inlet. The inner inlet section is shorter than the outer inlet section and has an inner surface which is an extension of a surface of an inner wall of the compressor housing which is swept by edges of the impeller wheel blades. The arrangement is such that an annular flow path is defined between the two tubular inlet sections which is open at its upstream end and which is provided with apertures at its downstream end which communicate with the inner surface of the compressor housing which faces the impeller wheel.

In operation, the pressure within the annular flow passage surrounding the compressor inducer is normally lower than atmospheric pressure and during high gas flow and high speed operation of the impeller wheel the pressure in the area swept by the impeller wheel is less than that in the annular passage. Thus, under such conditions air flows inward from the annular passage to the impeller wheel thereby increasing the amount of air reaching the impeller wheel, and increasing the maximum flow capacity of the compressor. However, as the flow through the impeller wheel drops, or as the speed of the impeller wheel drops, so the amount of air drawn into the impeller wheel through the annular passage decreases until equilibrium is reached. A further drop in the impeller wheel flow or speed results in the pressure in the area swept by the impeller wheel increasing above that within the annular passage and thus there is a reversal in the direction of air flow through the annular passage. That is, under such conditions air flows outward from the impeller wheel to the upstream end of the annular passage and is returned to the compressor intake for recirculation. Increase in compressor gas flow or speed of the impeller wheel causes the reverse to happen, i.e. a decrease in the amount of air returned to the intake through the annular passage, followed by equilibrium, in turn followed by reversal of the air flow through the annular passage so that air is drawn in to the impeller wheel via the apertures communicating between the annular passage and the impeller.

It is well known that this arrangement stabilities the performance of the compressor increasing the maximum flow capacity and improving the surge margin, i.e. decreasing the flow at which the compressor surges. This is known as increasing the width of the compressor "map", which is a plot of the compressor characteristic. All of this is well known to the skilled person.

Compressor operation is extremely unstable under surge conditions due to large fluctuations in pressure and mass flow rate through the compressor. For many applications, such as in a turbocharger where the compressor supplies air to a reciprocating engine, these fluctuations in mass flow rate are unacceptable. As a result there is a continuing requirement to extend the usable flow range of compressors by improving the surge margin.

It is therefore an object of the present invention to provide a compressor inlet structure which improves upon the surge margin of a conventional MWE compressor.

According to the present invention there is provided a compressor for compressing a gas, the compressor comprising:

a housing defining an inlet and an outlet;

an impeller wheel including a plurality of vanes rotatably mounted within the housing;

the housing having an inner wall defining a surface located in close proximity to radially outer edges of impeller vanes which sweep across said surface as the impeller wheel rotates about its axis;

wherein the inlet comprises:

an outer tubular wall extending away from the impeller wheel in an upstream direction and forming a gas intake portion of the inlet;

an inner tubular wall of diameter D extending away from the impeller wheel in an upstream direction within the outer tubular wall and defining an inducer portion of the inlet;

an annular gas flow passage defined between the inner and outer tubular walls and having an upstream end and a downstream end separated by a length L1 measured along its axis, the upstream end of the annular passage communicating with the intake or inducer portions of the inlet through at least one upstream aperture;

at least one downstream aperture communicating between a downstream portion of the annular flow passage and said surface of the housing swept by the impeller vanes;

the inner tubular wall extending upstream of said at least one downstream aperture by a length L2 measured along its axis;

wherein L1/D>0.65 and/or L2/D>0.6.

The present invention provides an improvement in surge margin by extending the length of the inner tubular wall/annular flow passage (with a conventional MWE compressor the dimensions L1/D and L2/D do not exceed 0.6 and 0.5 respectively). The most significant dimension is thought to be L2/D since this is effectively the length of the annular passage through which the air will flow at surge.

Whereas much work has previously been carried out to optimize the location of the apertures communicating between the annular flow passage and the impeller wheel, the significance of the length of the flow passage/inducer portion of the inlet has not previously been appreciated. Indeed, compressors are often designed to be compact and occupy the smallest possible space so that the length of the inlet tends to be minimized. In addition conventional casting techniques used to manufacture compressor housings favor shorter inlet dimensions. In other words the prior art has generally been moving towards shortened inlet dimensions.

Tests have shown that improvements are particularly significant when L1/D is greater than 0.9 and/or L2/D is greater than 0.97.

The compressor according to the present invention is suited for inclusion in a turbocharger.

Other preferred and advantageous features of the invention will be apparent from the following description.

A specific embodiment of the present invention will now be described, with reference to the accompanying drawings, in which.

Figure 1:
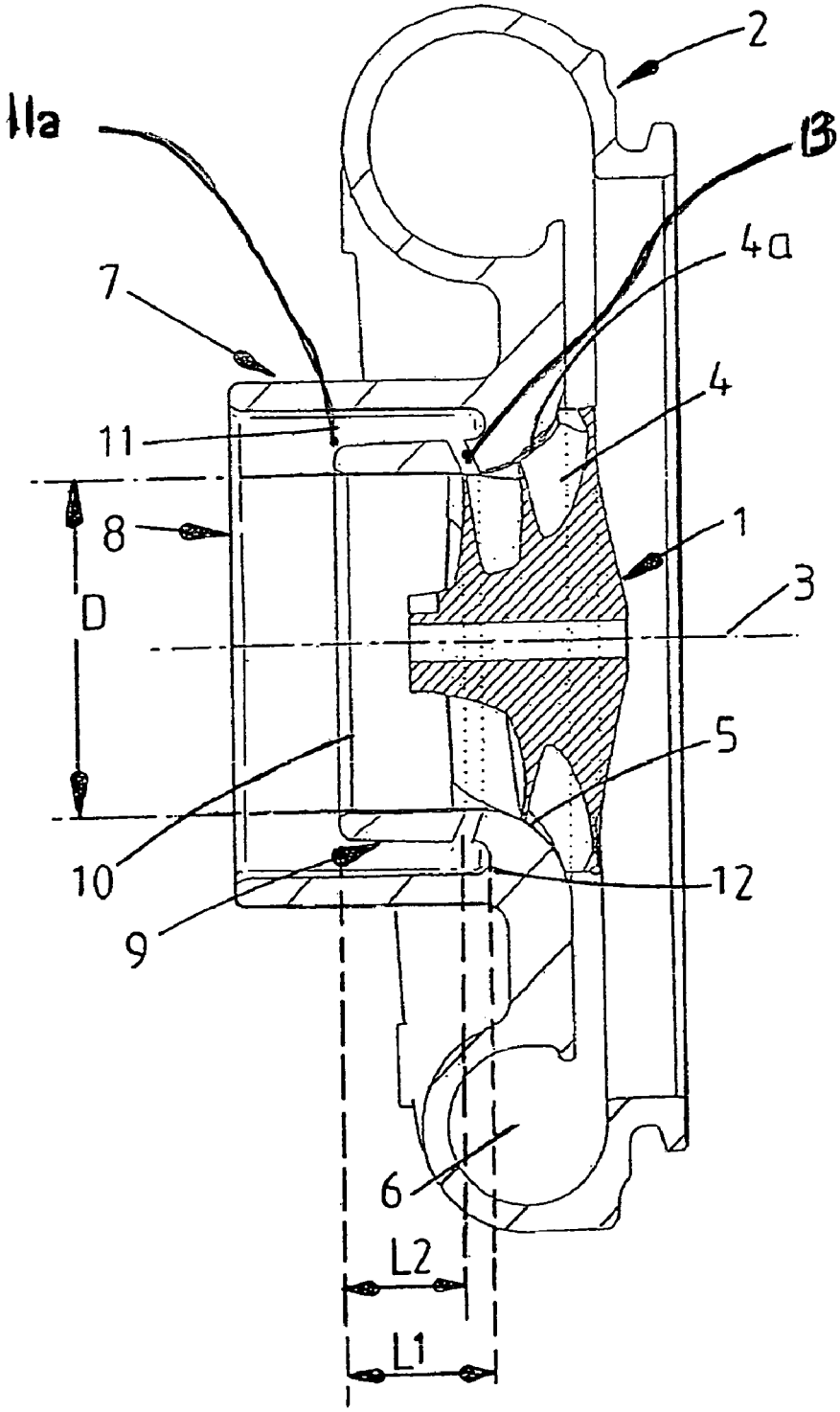
FIG. 1 (Prior Art)
FIG. 1 is a cross-section of part of a conventional MWE compressor.

Referring to FIG. 1 the illustrated MWE compressor is a centrifugal compressor comprising an impeller wheel 1 mounted within a compressor housing 2 on one end of a rotating shaft (not shown) which extends along compressor axis 3. The impeller wheel 1 has a plurality of vanes 4 each of which has an outer edge 4*a* which sweeps across an inner housing surface 5 when the impeller wheel 1 rotates about the axis 3. The compressor housing 2 defines an outlet volute 6 surrounding the impeller wheel, and an MWE inlet structure comprising an outer tubular wall 7 extending outwardly upstream of the impeller 1 and defining an intake 8 for gas such as air, and an inner tubular wall 9 which extends part way in to the intake 8 and defines the compressor inducer 10. The inner surface of the inner wall 9 is an upstream extension of the housing wall surface 5 which is swept by the outside edges 4*a* of the impeller blades 4.

An annular flow passage 11 is defined around the inducer 10 between the inner and outer walls 9 and 7 respectively. The flow passage 11 is open to the intake portion 8 of the inlet at its upstream end and is closed at its downstream end by an annular wall 12 of the housing 2, but communicates with the impeller wheel 1 via apertures 13 formed through the housing. The upstream end of the annular passage 11 communicates with the intake or inducer portions 8, 10 through at least one upstream aperture and in one form the at least one upstream aperture is an annular opening 11*a*. The apertures 13 communicate between a downstream portion of the annular flow passage 11 and the inner surface 5 of the housing 2 which is swept by the outer edges 4*a* of the impeller wheel blades 4. The apertures 13 are typically defined by an annular slot bridged by circumferentially spaced web portions. There may for instance be four such web portions so that each aperture 13 extends approximately 90.degree. around the impeller wheel 4. The apertures could however have other forms, for example comprising an annular array of relatively small diameter bores.

The flow passage 11 thus has an overall axial length L1 defined between its upstream end (defined where the passage 11 opens to inlet) and its downstream end (the axially innermost point of the passage 11). The annular passage also has an axial length L2 defined between its upstream end and the axial location of the apertures 13, which corresponds to the axial length of the portion of the inner tubular wall extending upstream of the apertures 13.

The conventional MWE compressor illustrated in FIG. 1 operates as is described above in the introduction to this specification. In summary, when the flow rate through the compressor is high, air passes axially along the annular flow path 11 towards the impeller wheel 1, flowing to the impeller wheel 1 through the apertures 13. When the flow through the compressor is low, the direction of air flow through the annular flow passage 11 is reversed so that air passes from the impeller wheel, through the apertures 13, and through the annular flow passage 11 in an upstream direction and is reintroduced into the air intake 8 for re-circulation through the compressor. This stabilities the performance of the compressor improving both the compressor surge margin and choke flow.

Figure 2:
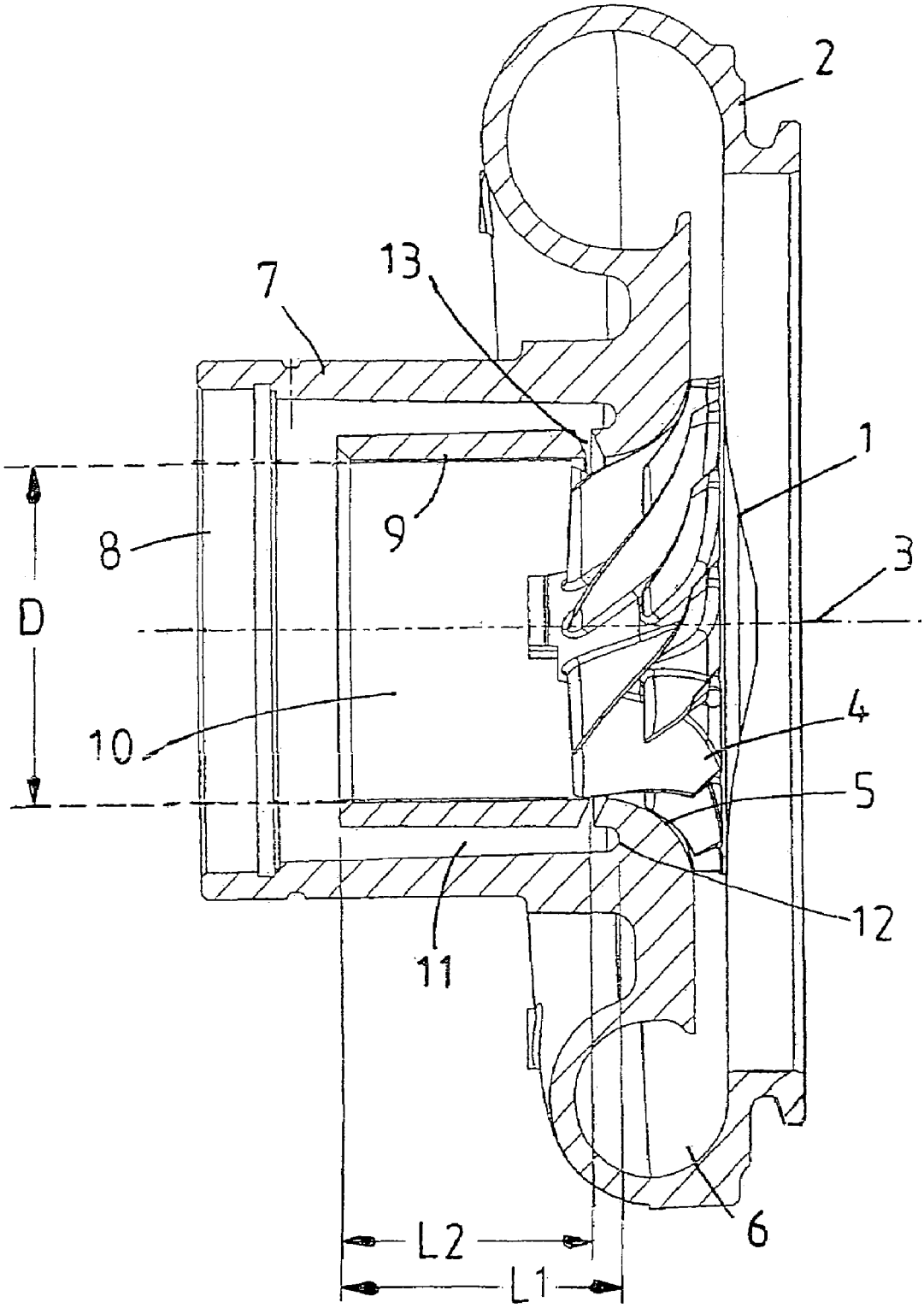
FIG. 2 is a cross-section through part of an MWE compressor modified in accordance with a first embodiment of the present invention.

FIG. 2 illustrates a modification of the conventional MWE compressor of FIG. 1 in accordance with a first embodiment of the present invention. Components which correspond to those of the compressor of FIG. 1 are identified by the same reference numerals as used in FIG. 1. Thus, it will be seen that the illustrated compressor in accordance with the present invention is identical to the conventional MWE compressor of FIG. 1 except that the axial length of the inlet is extended.

Referring to FIG. 2 in more detail, the inner tubular wall 9 extends upstream of the compressor to greater extent than is conventional, and the length of the outer tubular wall 7 is similarly extended to accommodate the longer inner wall 9. Thus the overall axial length L1 of the annular flow passage 11 is extended, as is the length L2. Specifically, the present inventors have found that extending the length of the annular passage to the extent that L1/D>0.65 and/or L2/D>0.6, where D is the internal diameter of the inner tubular wall, greatly increases the surge margin of the compressor. In one form, inner tubular wall 9 and the outer tubular wall 7 are co-axial about compressor axis 3.

Figure 3:
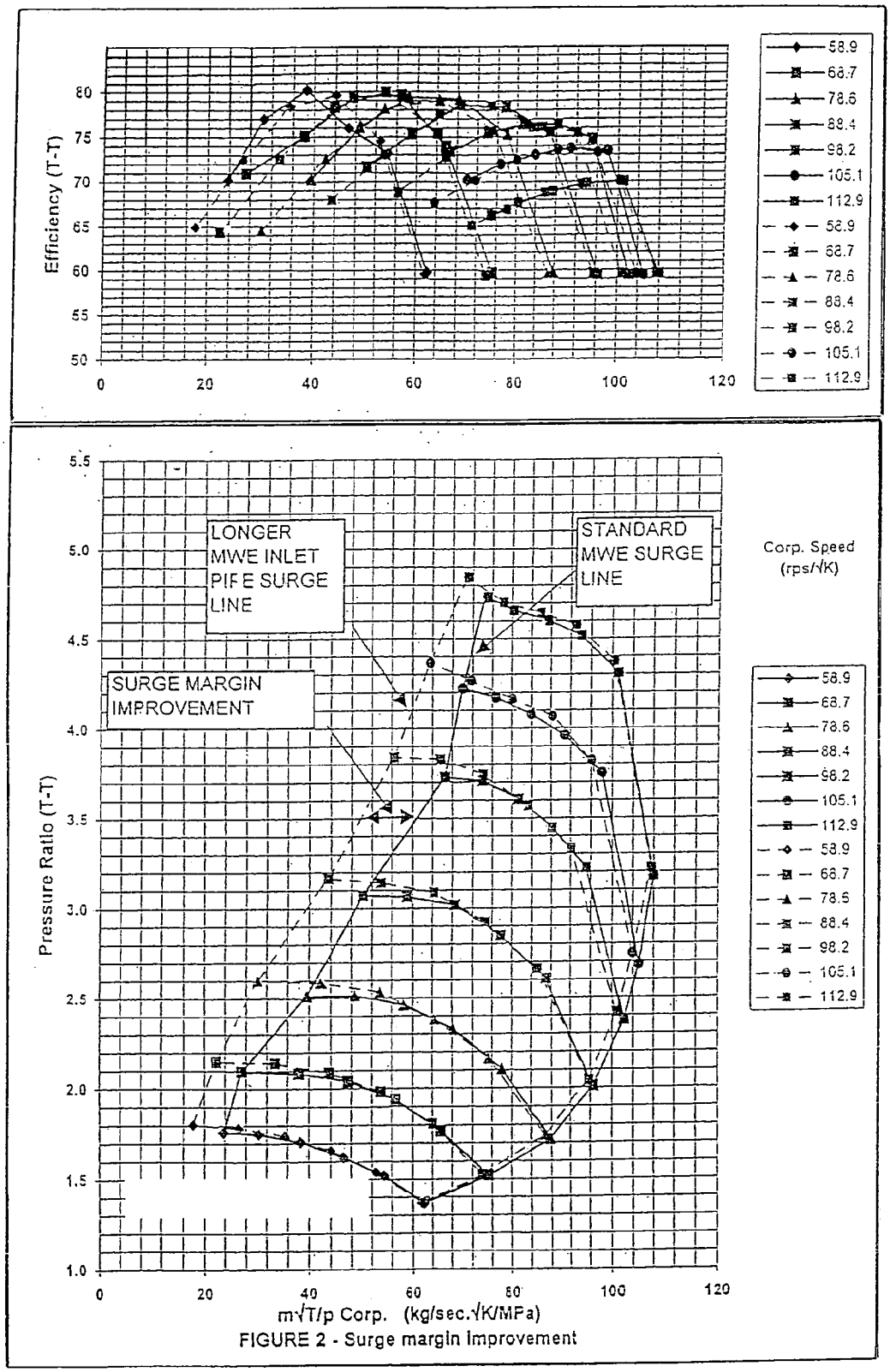
FIG. 3 is an over-plot comparing the performance map of a conventional MWE compressor as illustrated in FIG. 1 with the performance map of a compressor according to the present invention as illustrated in FIG. 2.

The improvement in performance provided by the present invention is illustrated by FIG. 3 which is an over-plot of the performance of a compressor according to the present invention (shown in dotted lines), with L1/D>1.41 and L2/D>1.33, in comparison with the performance of a conventional MWE compressor (shown in solid lines) with L1/D>0.35. The lower plot is the performance map which, as is well known, plots air flow rate through the compressor against the pressure ratio from the compressor inlet to outlet for a variety of impeller rotational speeds. The left hand line of the map represents the flow rates at which the compressor will surge for various turbocharger speeds and is known as the surge line. It can be seen the compressor according to the present invention has a significantly improved surge margin, providing up to a 25% improvement on the surge margin of the conventional MWE compressor. The maximum flow (choke flow) is largely unaffected (shown by the right hand line of the map) as is the compressor efficiency (as shown by the upper plot of FIG. 3 which plots the compressor efficiency as a function of air flow). It can however be seen that the embodiment of the invention has a slight increased pressure ratio capability compared to the convention MWE compressor.

Figure 4A:
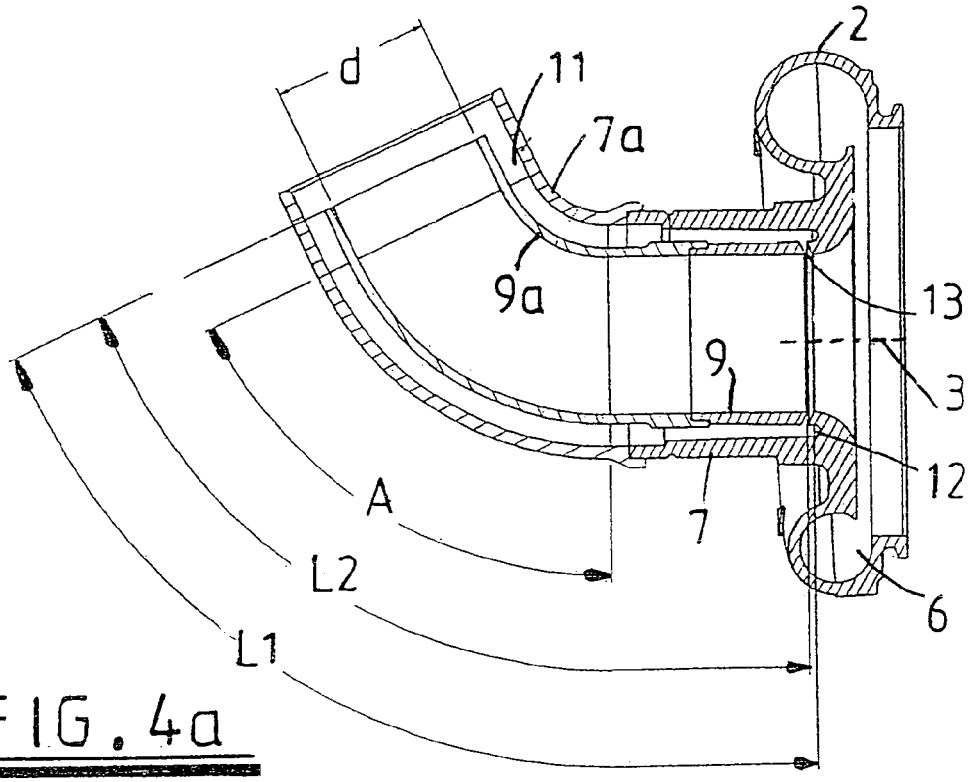
FIGS. 4*a* and 4*b* illustrate two further embodiments of the present invention.
Figure 4B:
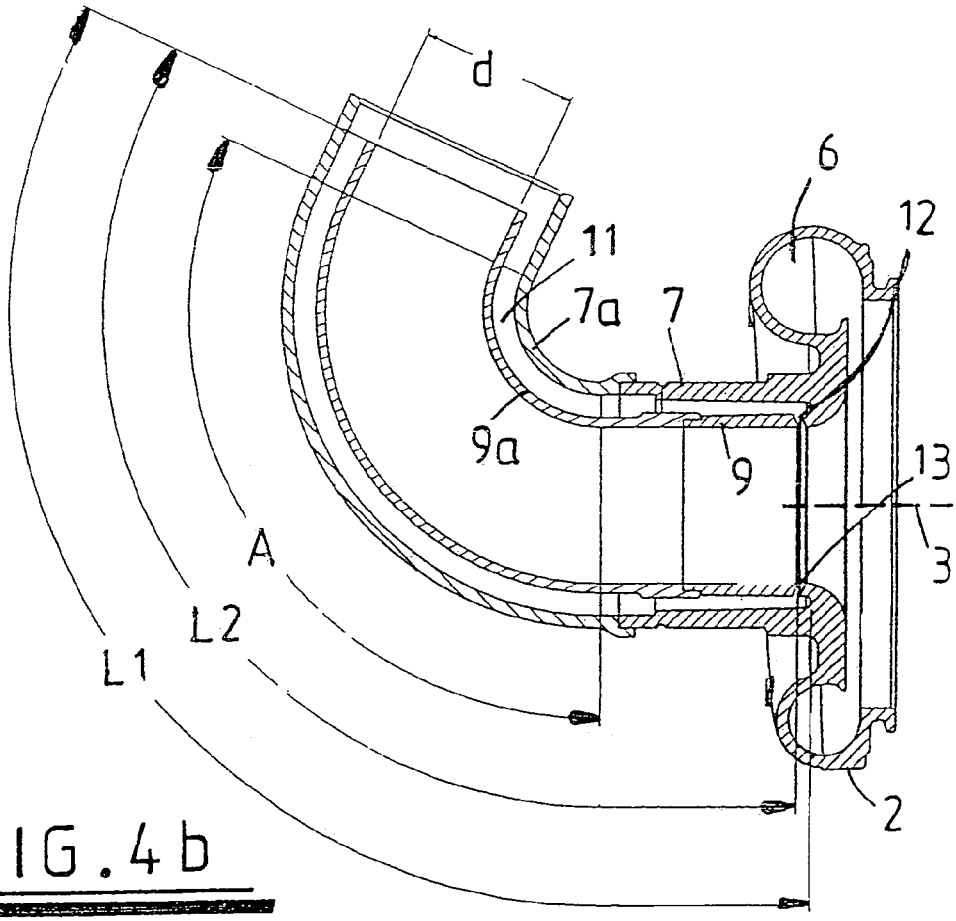

The present invention relates to the length of the inlet and other aspects of the compressor and inlet structure may be entirely conventional. In one form, each of the lengths L1 and L2, as shown in FIG. 2, is entirely straight. Moreover, the inlet need not be straight but could have one or more bends. Examples of embodiments of the present invention having curved inlet structures are illustrated in FIGS. 4*a* and 4*b* (which show the housing with impeller wheel omitted). In each case the inner and outer tubular walls 9 and 7 have extension portions 9*a* and 7*a* respectively which have axes that curve away from the axis 3 of the impeller (not shown). The two structures differ from each other only in the length and angle of curvature A of the curved portions 7*a* and 9*a*. With such embodiments the lengths L1 and L2 are measured along the axis of the tubular portions 7/7*a* and 9/9*a* which in these examples comprise both straight and curved portions. In other embodiments the lengths may be entirely curved.

With reference to FIG. 2, there is illustrated one form of the invention where the diameter D is substantially constant along substantially the entire length L2 of the inner tubular wall 9. In some embodiments the diameter of the inner tubular wall may vary along its length. In this instance, the value of D taken for determination of the lengths L1 and L2 is preferably the diameter of the downstream portion of the inner tubular wall. In one form of the present invention the diameter D is the minimum diameter of the inner tubular wall 9 along length L2. In another form of the present invention, the diameter D is the maximum diameter of the inner tubular wall 9 along length L2. In yet another form the diameter D is the average diameter of the inner tubular wall 9 along length L2.

Other possible modifications to the embodiments of the invention described above will be readily apparent to the appropriately skilled person.

Compressors in accordance with the present invention may have many applications and in particular are suitable for incorporation in turbochargers.

The invention claimed is:

1. A compressor for compressing a gas, the compressor comprising:

a housing defining an inlet and an outlet;

an impeller wheel including a plurality of vanes rotatably mounted within the housing;

the housing having an inner wall defining a surface located in close proximity to radially outer edges of impeller vanes which sweep across said surface as the impeller wheel rotates about its axis;

wherein the inlet comprises:

an outer tubular wall extending away from the impeller wheel in an upstream direction and forming a gas intake portion of the inlet;

an inner tubular wall having an internal diameter D extending away from the impeller wheel in an upstream direction within the outer tubular wall and defining an inducer portion of the inlet;

an annular gas flow passage defined between the inner and outer tubular walls and having an upstream end and a downstream end separated by a length L1 measured along an annular gas flow passage axis, the upstream end of the annular passage communicating with the intake or inducer portions of the inlet through at least one upstream aperture;

at least one downstream aperture communicating between a downstream portion of the annular flow passage and said surface of the housing swept by the impeller vanes;

the inner tubular wall extending upstream of said at least one downstream aperture by a length L2 measured along the annular gas flow passage axis, said internal diameter D being constant along substantially the entire length L2 of the inner tubular wall;

wherein L1/D>0.65 and/or L2/D>0.6.

2. A compressor according to claim 1, wherein L1/D>0.9 and/or L2/D>0.97.

3. A compressor according to claim 1, wherein the annular flow passage is open at its upstream end, such that said at least one upstream aperture is an annular opening defined at the upstream end of the inner tubular wall between the inner and outer tubular walls.

4. A compressor according to claim 1, wherein the inner tubular wall and the annular passage wall are co-axial having an axis which is a continuation of the impeller wheel axis.

5. A compressor according to claim 1, wherein the lengths L1 and L2 are entirely straight.

6. A compressor according to claim 1, wherein the lengths L1 and L2 are at least in part curved.

7. A turbocharger comprising a compressor, wherein the compressor comprises:

a housing defining an inlet and an outlet;

an impeller wheel including a plurality of vanes rotatably mounted within the housing;

the housing having an inner wall defining a surface located in close proximity to radially outer edges of impeller vanes which sweep across said surface as the impeller wheel rotates about its axis;

wherein the inlet comprises:

an outer tubular wall extending away from the impeller wheel in an upstream direction and forming a gas intake portion of the inlet;

an inner tubular wall having an internal diameter D extending away from the impeller wheel in an upstream direction within the outer tubular wall and defining an inducer portion of the inlet;

an annular gas flow passage defined between the inner and outer tubular walls and having an upstream end and a downstream end separated by a length L1 measured along an annular gas flow passage axis, the upstream end of the annular passage communicating with the intake or inducer portions of the inlet through at least one upstream aperture;

at least one downstream aperture communicating between a downstream portion of the annular flow passage and said surface of the housing swept by the impeller vanes;

the inner tubular wall extending upstream of said at least one downstream aperture by a length L2 measured along said annular gas flow passage axis, said internal diameter D being constant along substantially the entire length L2 of the inner tubular wall;

wherein L1//D>0.65 and/or L2/D>0.6.

8. A compressor for compressing a gas, the compressor comprising:

a housing defining an inlet and an outlet;

an impeller wheel including a plurality of vanes rotatably mounted within the housing;

the housing having an inner wall defining a surface located in close proximity to radially outer edges of impeller vanes which sweep across said surface as the impeller wheel rotates about its axis;

wherein the inlet comprises:

an outer tubular wall extending away from the impeller wheel in an upstream direction and forming a gas intake portion of the inlet;

an inner tubular wall of diameter D extending away from the impeller wheel in an upstream direction within the outer tubular wall and defining an inducer portion of the inlet;

an annular gas flow passage defined between the inner and outer tubular walls and having an upstream end and a downstream end separated by a length L1 measured along an annular gas flow passage axis and at least in part curved, the upstream end of the annular passage communicating with the intake or inducer portions of the inlet through at least one upstream aperture;

at least one downstream aperture communicating between a downstream portion of the annular flow passage and said surface of the housing swept by the impeller vanes;

the inner tubular wall extending upstream of said at least one downstream aperture by a length L2 measured along an inner tubular axis and at least in part curved;

wherein L1/D>0.65 and/or L2/D>0.6.

9. A compressor according to claim 8, wherein L1/D>0.9 and/or L2/D>0.97.

10. A compressor according to claim 8, wherein the annular flow passage is open at its upstream end, such that said at least one upstream aperture is an annular opening defined at the upstream end of the inner tubular wall between the inner and outer tubular walls.

11. A compressor according to claim 8, wherein said diameter D is constant along substantially the entire length L2 of the inner tubular wall.

12. A compressor according to claim 8, wherein said diameter D is constant along substantially the entire length L2 of the inner tubular wall.

13. A compressor according to claim 8, wherein said diameter D is the minimum diameter of the inner tubular wall along its length L2.

14. A compressor according to claim 8, wherein said diameter D is the maximum diameter of the inner tubular wall along its length L2.

15. A compressor according to claim 8, wherein the diameter D is the average diameter of the inner tubular wall along its length L2.

* * * * *